US005285931A

United States Patent [19]

Alfons

[11] Patent Number: 5,285,931

[45] **Date of Patent: * Feb. 15, 1994**

[54] PRESSURE CAPSULE FOR SPRAY CAN AND SPRAY CAN WHICH UTILIZES SUCH PRESSURE CAPSULE

[75] Inventor: Vandoninck Alfons, Antwerpen, Belgium

[73] Assignee: Jaico C.V., cooperatieve vennootschap, Opglabeek, Belgium

[ * ] Notice: The portion of the term of this patent subsequent to Feb. 26, 2008 has been disclaimed.

[21] Appl. No.: 648,915

[22] Filed: Feb. 1, 1991

[30] Foreign Application Priority Data

Feb. 9, 1990 [BE] Belgium ..... 9000156

[51] Int. Cl.[5] ..... B67D 5/08

[52] U.S. Cl. ..... 222/61; 222/130; 222/399; 222/494; 222/510; 137/903

[58] Field of Search ..... 222/3, 61, 129, 130, 222/145, 396, 394, 397, 399, 491, 494, 510; 137/903, 505.39, 852; 251/211

[56] References Cited

U.S. PATENT DOCUMENTS

| | | | |
|---|---|---|---|
| 1,349,443 | 8/1920 | Stokes | 137/505.39 |
| 2,794,579 | 6/1957 | McKernan | 222/399 |
| 3,243,085 | 3/1966 | Wilson | 222/399 |
| 3,258,163 | 6/1966 | Brush | 222/399 |
| 3,468,137 | 9/1969 | Welty | 222/3 |
| 3,613,954 | 10/1971 | Bayne | 222/399 |
| 3,815,793 | 6/1974 | Morane et al. | 222/399 |
| 3,995,778 | 12/1976 | Gamadia | 222/399 |
| 4,049,158 | 9/1977 | Lo et al. | 222/399 |
| 4,399,158 | 8/1983 | Bardsley et al. | 222/145 |
| 4,995,533 | 2/1991 | Vandoninck | 222/399 |
| 5,090,595 | 2/1992 | Vandoninck | 222/399 |
| 5,110,014 | 5/1992 | Doundoulakis | 222/399 |

FOREIGN PATENT DOCUMENTS 0349053 1/1990 European Pat. Off. .

*Primary Examiner*—Andres Kashnikow
*Assistant Examiner*—Philippe Derakashani
*Attorney, Agent, or Firm*—Foley & Lardner

[57] ABSTRACT

A pressure capsule for a spray can includes a housing with a chamber disposed therein and a valve mounted within a wall of the housing, the valve is capable of being moved into an open and a closed position such that the valve is moved into the closed position when (1) the pressure capsule is placed in an atmospheric environment and (2) the pressure capsule is placed in a spray can and subjected to a pressure equal to or greater than the operating pressure of the spray can.

33 Claims, 3 Drawing Sheets

PRESSURE CAPSULE FOR SPRAY CAN AND SPRAY CAN WHICH UTILIZES SUCH PRESSURE CAPSULE

BACKGROUND OF THE INVENTION

This invention relates to a pressure capsule as well as a spray can which utilizes such pressure capsule.

The present invention more especially relates to a pressure capsule which prior to or during the filling of a spray can or similar is installed in the latter and offers the possibility of possibly making use of, either compressed air, or an inert gas as means of propulsion for such spray can, all of which such that a spray can is obtained which has no detrimental effect on the environment and which furthermore has the possibility and the simplicity of operation which at this moment are only to be found with spray cans with the known harmful propellants.

1. Field of the Invention

From the Belgian Pat. No. 8801131 of applicant a pressure capsule is already known which principally consists of at least two chambers of which the first is intended to be filled with a fluid under relatively high pressure and of which the second is intended to be filled with a fluid up to a pressure almost equal to the over pressure which normally exists in a spray can and which is necessary for expelling a liquid; in the wall of the first chamber a valve; in the wall of the second chamber a membrane that can command the aforementioned valve; and a removable element that in its unremoved position holds the valve closed.

With this known pressure capsule the aforementioned removable element can directly or indirectly act on the valve in order to hold this closed and preferably consists of a material meltable by little heat, all of which such that, after the aforementioned removable element is removed, the aforementioned valve is so regulated by the membrane that fluid is released from the first chamber as long as the pressure in the vicinity of the pressure capsule decreases or at least is notably lower than the pressure in the second chamber of the pressure capsule.

Although this known pressure capsule works very efficiently the present invention relates to a pressure capsule which still shows considerable additional advantages.

SUMMARY OF THE INVENTION

A first advantage of the pressure capsule according to the invention is that no removable element is necessary so that heating of the spray can, with the intention of melting away the removable element, is no longer necessary.

Another advantage of the pressure capsule according to the invention is that in the spray can, after the pressure capsule is installed therein, a specific pre-pressure is provided, preferably at least the operating pressure of the spray can, through which the aforementioned pressure capsule can remain smaller because of the fact that less pressure fluid is necessary in the pressure capsule so that consequently the material costs are also lower.

Yet another advantage of the pressure capsule according to the invention is the very great safety of a spray can equipped with such pressure capsule since, with a possible tearing, leakage or similar of the spray can, the pressure capsule automatically closes, since at that moment the pressure around the pressure capsule drops.

Another advantage of the pressure capsule according to the invention is that it is no longer necessary, which is the case with a pressure capsule with removable element, during its manufacture, to determine the correct location of the small hole that the removable element must receive, since the opening or passage of the pressure capsule which is in contact with the environment can be provided in any manner and in any place, so that a difficult orientation operation can be omitted.

Another advantage still of the pressure capsule according to the invention is that the dimensions of the aforementioned opening or passage have no importance with regard to the operation of the pressure capsule.

Yet another advantage of the pressure capsule according to the invention is ultimately that it is extremely simple to realize, either as dual chamber pressure capsule, or as single chamber pressure capsule.

The pressure capsule according to the invention which shows the aforementioned and other advantages principally consists of at least one chamber which is intended to filled with fluid under relatively high pressure; in the wall of this chamber a valve; means which can command the valve; means which hold the valve in closed position when the pressure capsule is in an atmospheric environment, on the one hand, as well as when the pressure capsule is in an environment where the pressure is equal to or greater than the operating pressure in the spray can, in other words the pressure which is necessary for the expulsion of a liquid, on the other hand; whereby the rod of the valve is attached to a membrane in the chamber, respectively to a disk shaped extremity and whereby the space between the walls, respectively between the wall and the disk shaped extremity, is in continuous connection with the environment.

BRIEF DESCRIPTION OF THE DRAWINGS

In order to show better the characteristics according to the present invention, some preferred embodiments are described hereafter, as examples and without any restrictive character with reference to the enclosed drawings in which.

DETAILED DESCRIPTION OF THE PREFERRED EMBODIMENT

Figure 1:
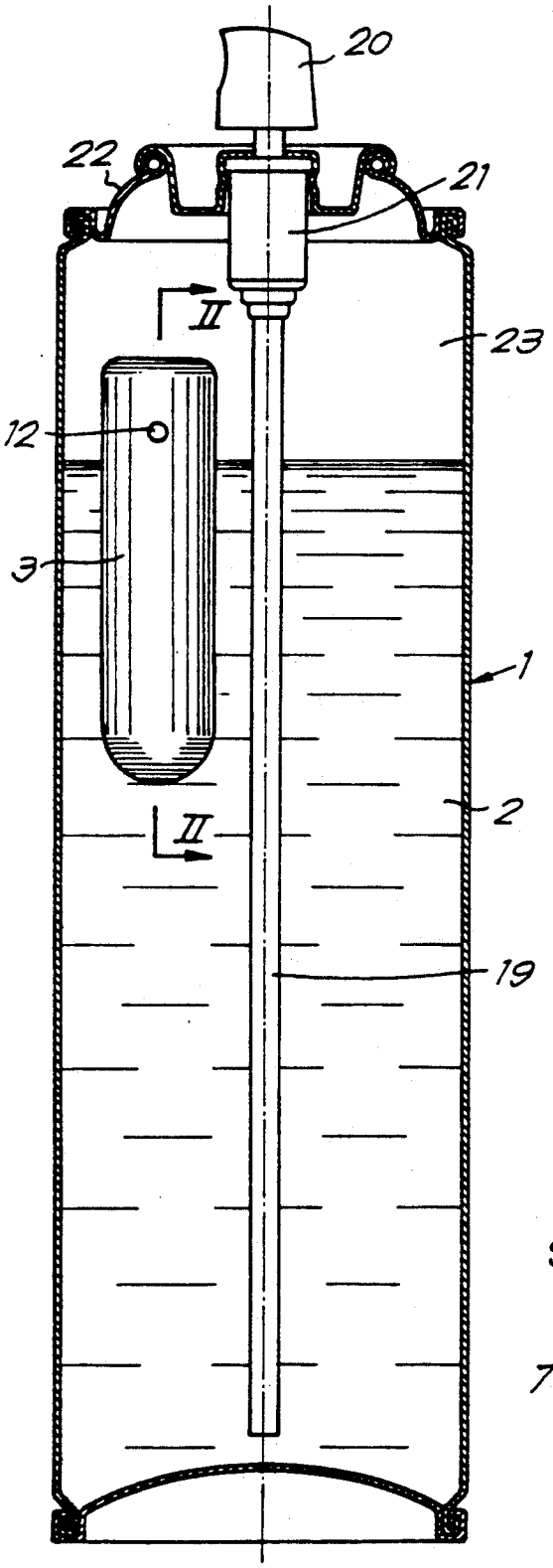
FIG. 1 shows a spray can in which a pressure capsule according to the invention is utilized.

In FIG. 1 a classic spray can 1 is shown which is filled with a liquid 2 to be dispersed and in which a pressure capsule 3 according to the invention is installed.

Figure 2:
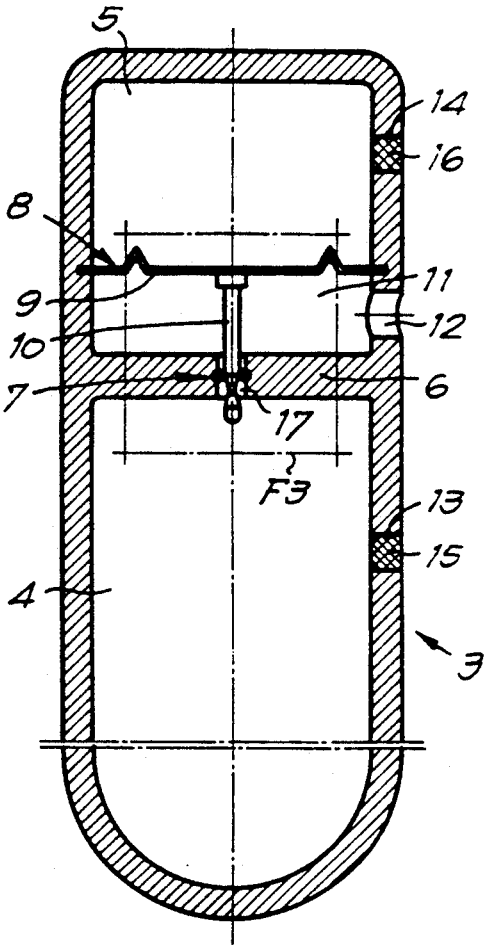
FIG. 2 shows on larger scale a section of a pressure capsule according to the invention, more especially according to line II—II in FIG. 1.

The pressure capsule 3, as shown in FIG. 2, can be constructed in any manner by assembling various parts by screwing, welding or similar. For simplicity the pressure capsule in FIG. 2 is however shown as being of one unit.

The pressure capsule 3 in this embodiment principally consists of two chambers, respectively 4 and 5, of which the first chamber 4 is intended to be filled with a fluid under relatively high pressure and of which the second chamber 5 is intended to be filled with a fluid under a pressure which is equal or almost equal to the over pressure which is normally applied in a spray can 1.

A valve 7 is provided in the wall 6 of the first chamber, while in the second chamber 5 a wall 8 is installed which is provided with a membrane 9 that bears a rod 10 to which the valve 7 is attached. From the preceding it follows that the walls in which, on the one hand, the valve 7 and, on the other hand, the membrane 9 are installed, are located opposite each other whereby the space 11 between the walls 6 and 8 are directly connected to the vicinity of the pressure capsule 3, in this case via a small hole 12.

In the embodiment according to FIG. 2 the chambers 4 and 5 each show an opening, respectively 13, 14, which can be closed by suitable sealing means 15, 16.

The valve 7 is in this case formed by, on the one hand, the aforementioned rod 10 which is attached by one extremity to the membrane 9, whereby this rod passes through an opening in the wall 6 and underneath shows a peripheral groove 17, which for example is produced in a diabolo shape and, on the other hand, a sealing ring 18 which is installed in the aforementioned opening in the wall 6 and which functions as seat for the valve 7.

The inner diameter of the sealing ring 18, which is produced in an elastic material, for example rubber or similar, will preferably be somewhat smaller than the outer diameter of the rod 10 whereby the sealing ring 18 is placed in the aforementioned peripheral groove 17.

According to the invention, for example via the opening 13, the first chamber 4 is filled with a fluid under high pressure, for example of the order of 30 kg/cm$^2$, such as compressed air or another gas, preferably, but not necessarily, an inert gas, after which the opening 13 is sealed off with suitable means, such as by gluing, by welding, by a screw plug or similar 15.

The chamber 5 is likewise filled via the opening 14 with compressed air or another fluid up to an over pressure which is approximately equal to the desired operating pressure in the spray can 1, whereby this operating pressure is for example of the order of 3 kg/cm$^2$. Once at this pressure the chamber 5 will be sealed off by means 16, such as for example by gluing, by welding, by a screw plug or similar.

The pressure capsule 3 as described above can be utilized very advantageously in a spray can 1 filled with liquid 2 in order to supply the pressure medium, in this case air, that serves to remove the liquid 2 from the spray can 1 via an ascending tube 19 and controlled through a valve 21 operatable by means of a press button 20.

For this purpose the pressure capsule 3 is installed in the spray can 1, prior to, during or after the filling of the spray can 1 with liquid 2 and prior to the installation of the cover 22 with the ascending tube 19 and the valve 21, after which according to the invention the spray can 1, such as this is the case with traditional spray cans, is brought up to operating pressure, in other words up to a pressure which is equal to or is somewhat higher than the pressure in the chamber 5.

Figure 3:
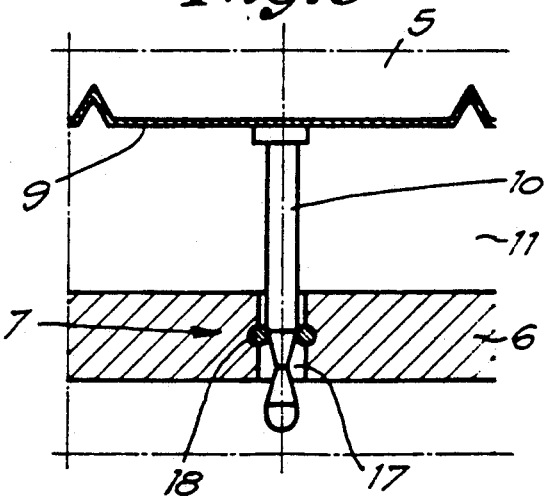
FIG. 3 shows on larger scale the part that is indicated by F3 in FIG. 2.
Figure 5:
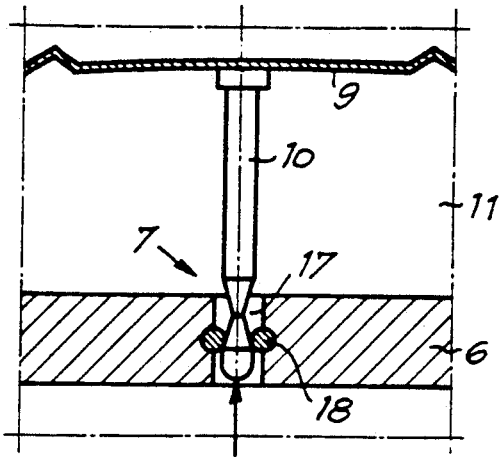
FIGS. 4 and 5 are similar views to that from FIG. 3 but for two other characteristic positions.
Figure 4:
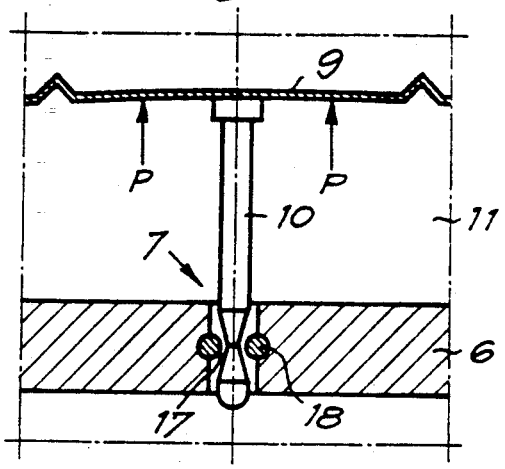

Because of this it is achieved that the membrane 9, under influence of the pressure in the space 23 above the liquid 2, on the one hand, and the small additional pressure of the fluid in the chamber 4 at the extremity of the rod 10, on the other hand, in FIG. 2 moves upwards through which the sealing element 10 moves out of the position as shown in FIG. 3 to the position as shown in FIG. 4, with as result that compressed air or similar escapes out of the chamber 4 through the opening 12 into the space 23, all of which such that the upward pressure P on the membrane 9 increases with ultimately as result that the membrane 9 is placed in the position as shown in FIG. 5, in other words in the position whereby the valve 7 in its second position works together with the sealing ring 18 so that removal of compressed air from chamber 4 towards the space 23 is stopped.

When at this time, through the depression of the press button 20, liquid 2 is dispersed under influence of the pressure of the fluid in the chamber 23, the pressure in the space 23 will decrease until an equilibrium is reached with the pressure in chamber 5 of the pressure capsule 3, through which the membrane moves downward and the valve 7 comes into the position of FIG. 4.

It is clear that at this time compressed air escapes out of chamber 4 towards the space 23 through which the pressure P on the membrane 9 again increases so that, when the force exerted under the membrane 9 becomes greater than the force above the membrane, the latter again moves upwards in order to close off the supply of compressed air from the chamber 4 towards the chamber 23, as shown in FIG. 5.

Figure 6:
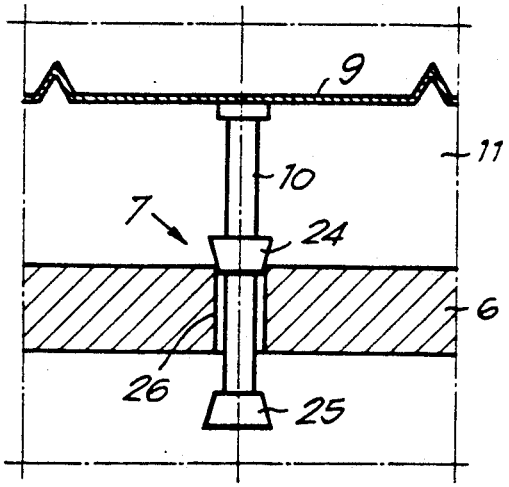
FIGS. 6 and 7 show variants of FIG. 3.

In FIG. 6 an embodiment variant is shown whereby the valve 7 is formed by sealing elements for example in the form of a frustum of a cone, respectively 24 and 25, which can alternatively close off the opening 26 in the wall 6.

Figure 7:
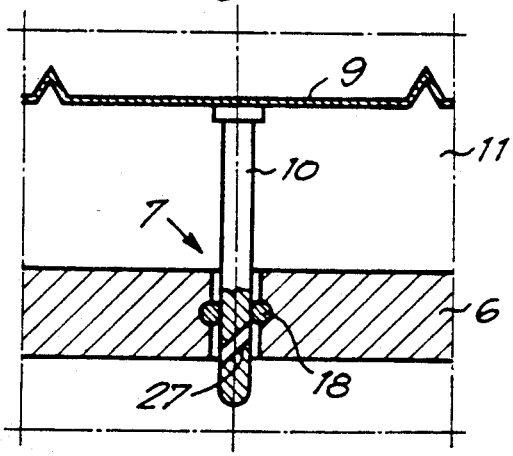

An embodiment is shown in FIG. 7 whereby the valve 7 is formed by an oblique passage 27 which can move under or above the sealing ring 18 when the valve 7 is closed, and just at the height of the sealing ring 18 when the valve 7 is opened.

Figure 8:
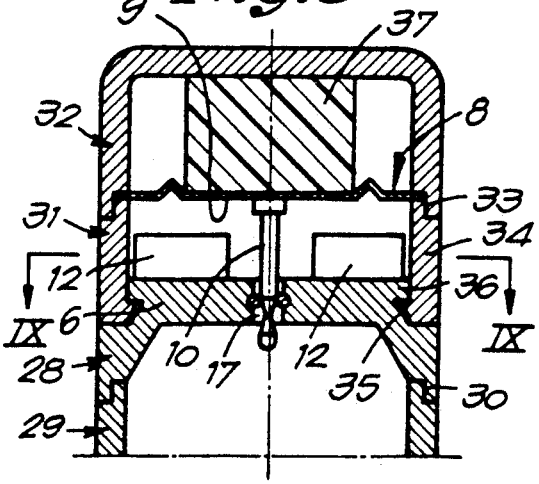
FIG. 8 shows a practical embodiment of a pressure capsule according to the invention.
Figure 9:
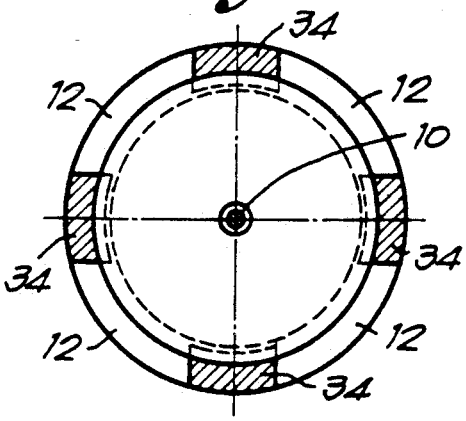
FIG. 9 shows a section according to line IX—IX in FIG. 8.

An embodiment is shown in schematic manner in FIGS. 8 and 9 whereby the lower chamber 4 consists of an upper part 28 and a lower part 29 which fit together suitably and are connected to each other by gluing, welding or similar 30 and whereby the upper chamber also consists of two parts, respectively 31 and 32, which are connected to each other in suitable manner by gluing or welding 33 with insertion of the wall 8 of the membrane 9.

In this embodiment the part 31 of the chamber 5 shows as it were four small legs 34 which underneath show an inwardly directed tooth shaped projection 35 which can work together, by clipping in, behind the edge 36 of the part 28 of the chamber 4.

In this case the opening 12 is formed between the aforementioned small legs 34.

It is clear that the pressure in the chamber 5 can be formed in whatever manner and need not necessarily be built up by means of a fluid. Indeed the pressure above the membrane 9 could also be formed by a suitable spring or similar for example an elastic material such as among others a small block of foam rubber 37.

Figure 10:
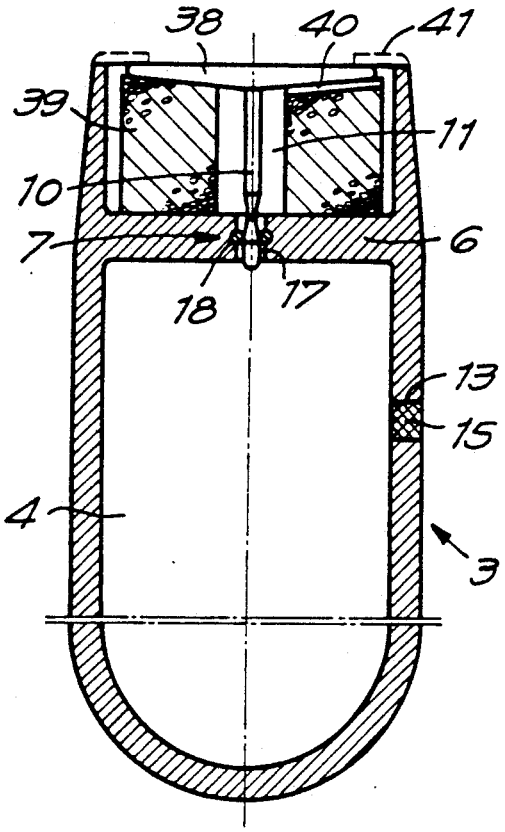
FIG. 10 shows another variant of a pressure capsule according to the invention

Another embodiment variant is shown in FIG. 10 which is based on a single chamber pressure capsule.

With this only the chamber 4 is provided which as with the dual chamber pressure capsule described above is filled with a fluid under relatively high pressure.

In this case the membrane 9 is replaced by a stiff disk shaped extremity 38 of the rod 10, whereby between the wall 6 of the chamber 4 and the aforementioned extremity 38 an elastic element 39 is installed, foam material, with closed cells, whereby the elasticity of the element 39, which as it were is the so-called reference pressure (to be compared to the pressure in the space 5 in the embodiment according to FIG. 2) which is present in the cells, will be chosen or determined in relation to the operating pressure in the spray can 1.

In the embodiment according to FIG. 10 a small annular block of foam material 39 is provided in which at least one groove, passage or similar 40 is made, whereby this small block 39 is attached to, on the one hand, the wall 6 and, on the other hand, the disk shaped extremity 38, for example by gluing or another attachment.

Figure 12:
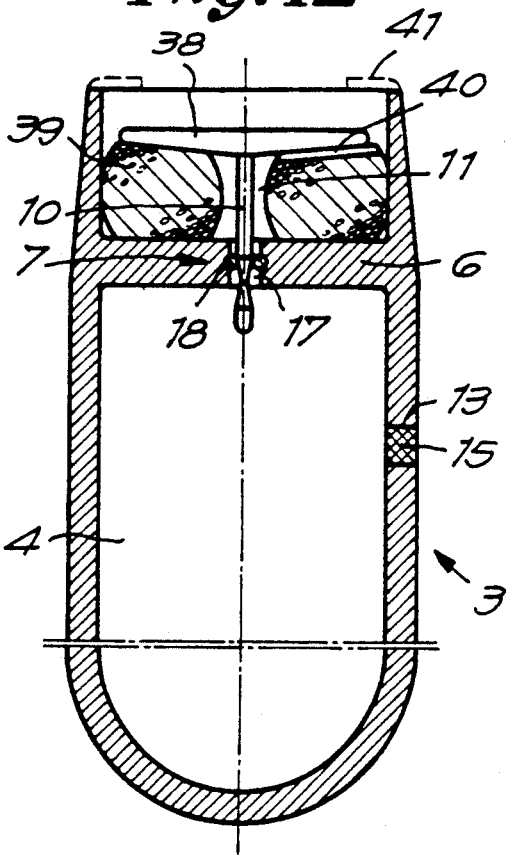
FIG. 12 shows a second position of FIG. 10.
Figure 11:
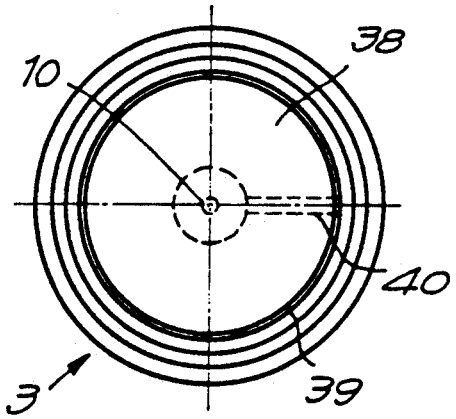
FIG. 11 shows a top view of FIG. 10.

The attachment of the small block 39 and the valve could for example also be effected by extending the housing of the pressure capsule to above the aforementioned extremity as is shown in dotted line in FIGS. 10 and 12, so that the upper position of the small block 39 is determined by the presence of the ring 41.

In FIG. 10 the position of the air pressure capsule is shown when this is in an atmospheric environment. The lower part of the valve 7 closed off the chamber 4 and ring 39 is in released position, whereby the pressure of the ring 39 or similar on the disk shaped extremity 38 is approximately equal to atmospheric pressure, whereby the pressure in the closed cells of the ring 39 amounts to one bar.

When the air pressure capsule according to FIG. 10 is inserted into a spray can 1 and the latter is brought up to operating pressure, the pressure exerted on the extremity 38 will be such that the seal 10 moves into the chamber 4 whereby the disk shaped extremity 38 presses on the spring, small block of foam material or similar 39 and brings this into the position as shown in FIG. 12, whereby the valve 7 is again closed off.

When now, through the spraying of the liquid, the pressure in the spray can 1 slowly decreases, the valve 7, respectively the rod 10 with the disk shaped extremity 38, will again move upwards under influence of the expansion effect of the small block or similar 39. Because of this an amount of compressed air can escape out of the chamber 4 along the valve 7 and arrive in the space 23 in the spray can 1 so that, just as with the preceding embodiment, the pressure in the space 23 again increases until the valve 7 again closes off the space 4.

It is clear that, through the correct choice of the material for the small block 39 or similar, on the one hand, and the surface area of the disk shaped extremity 38, on the other hand, the operating pressure in the space 23 of the spray can 1 can be determined.

The present invention is in no way restricted to the embodiments described as examples and shown in the attached drawings but a pressure capsule according to the invention can be implemented in all types of forms and dimensions without departing from the scope of the present invention.

We claim:

1. A pressure capsule for a spray can comprising: a housing having a plurality of walls defining first and second chambers therein, said first chamber being filled with a fluid under relatively high pressure;

a valve, disposed in a first one of said walls, having a rod;

a membrane, connected to said rod, which is disposed in said second chamber such that a space is defined between said membrane and said first wall;

means for communicating said space with the environment outside of said capsule; and means for moving said valve into a closed and an open position; wherein said valve is in said closed position when (1) said pressure capsule is placed in an atmospheric environment such that said space is in communication with the atmospheric environment via said communicating means and (2) said pressure capsule is disposed in said spray can said moving means is subjected to a pressure equal to or greater than the operating pressure of said spray can.

2. A pressure capsule according to claim 1, wherein said means for moving includes said membrane and means for exerting a pressure, which is substantially equal to the operating pressure of said spray can, on said membrane, and said means for exerting is disposed in said second chamber.

3. A pressure capsule according to claim 1, wherein said first and second chambers are coaxially aligned in a stacked relationship.

4. A pressure capsule according to claim 1, wherein said first wall has an opening therein through which said rod moves when said valve moves between said open and closed positions, and said valve includes said first wall opening.

5. A pressure capsule according to claim 4, wherein said rod has a peripheral groove therein and said valve includes a sealing ring disposed in said first wall opening such that when said peripheral groove and said sealing ring are aligned with each other a free passage is defined in said first wall opening.

6. A pressure capsule according to claim 5, wherein said peripheral groove is in the form of a diablo.

7. A pressure capsule according to claim 4, wherein said rod has an oblique passage passing therethrough, said valve includes a sealing ring disposed in said first wall opening, and said oblique passage can be positioned above, below and adjacent said sealing ring.

8. A pressure capsule according to claim 5, wherein the inner diameter of said sealing ring is smaller than the outer diameter of said rod.

9. A pressure capsule according to claim 5, wherein said sealing ring is an elastic material.

10. A pressure capsule according to claim 4, wherein said rod includes first and second sealing elements disposed thereon and said first wall is disposed between said first and second sealing elements such that said first wall opening is open and closed by said sealing elements as said sealing elements move with said rod.

11. A pressure capsule according to claim 1, wherein said second chamber has a fluid therein which pressurizes said second chamber.

12. A pressure capsule according to claim 2, wherein said means for exerting a pressure includes an elastic member disposed between said membrane and an end wall of said chamber.

13. A pressure capsule according to claim 12, wherein said elastic member is a spring.

14. A pressure capsule according to claim 12, wherein said elastic member is a block of foam rubber.

15. A pressure capsule according to claim 1, wherein at least one of said walls defining said first and second chamber has a leg portion having a tooth projection which projects toward a respective one of said chambers and engages an edge of one of the walls defining said other chamber.

16. A pressure capsule according to claim 1, wherein each of said first and second chambers is defined by two parts which are connected to each other.

17. A pressure capsule according to claim 1, wherein said means for communicating is a hole disposed in one of said walls.

18. A pressure capsule according to claim 15, wherein at least one of said walls defining said first and second chambers has a plurality of leg portions which define a plurality of passages therebetween, said means for communicating including said passages.

19. A pressure capsule according to claim 14, wherein said foam rubber has a closed cell structure.

20. A pressure capsule according to claim 1, wherein said means for moving includes an elastic member which is disposed in said second chamber and which exerts a pressure equal to atmospheric pressure on said membrane.

21. A pressure capsule according to claim 1, wherein said means for moving includes a block of closed cell foam rubber which is disposed in said second chamber, and which exerts a pressure of one bar on said membrane.

22. A pressure capsule for a spray can comprising:

a housing having a plurality of walls defining a chamber therein, said chamber being filled with pressurized fluid;

a valve, disposed in a first one of said walls, having a rod;

a disk shaped extremity being connected to said rod and being dispcsed outside said chamber such that a space is defined between said first wall and said disk shaped extremity;

means for communicating said space with the environment outside of said capsule; and means for moving said valve into a closed and an open position; wherein said valve is in said closed position when (1) said pressure capsule is placed in an atmospheric environment and (2) said pressure capsule is disposed in said spray can and said moving means is subjected to a pressure equal to or greater than the operating pressure of said spray can.

23. A pressure capsule according to claim 22, wherein said rod extends outside said chamber, and said means for moving includes an elastic member disposed between said disk shaped extremity and said first wall, said elastic member exerting a pressure on said valve which is equal to atmospheric pressure.

24. A pressure capsule according to claim 22 wherein said valve includes an opening in said first wall through which said rod moves when said valve moves between said open and closed positions, and wherein said rod has a peripheral groove in the form of a diablo disposed therein and said valve includes a sealing ring disposed in said first wall opening.

25. A pressure capsule according to claim 22 wherein the inner diameter of the sealing ring is smaller than the outer diameter of said rod, and said sealing ring is an elastic material.

26. A pressure capsule according to claim 22, wherein said rod includes first and second sealing elements disposed thereon, said first wall is disposed between said first and second sealing elements, and said first wall has an opening therein through which said rod moves such that said first wall opening is open and closed by said sealing elements as said sealing elements move with said rod.

27. A pressure capsule according to claim 23, wherein said elastic member is a small block of closed cell foam rubber.

28. A pressure capsule according to claim 27, wherein said elastic member has at least one passageway therein.

29. A pressure capsule according to claim 22, wherein said housing has an annular stop connected thereto which extends above said disk shaped extremity.

30. A pressure capsule according to claim 27, wherein said small block is attached to said first wall and to said disk shaped extremity.

31. A pressure capsule according to claim 30, wherein said small block is attached by gluing.

32. A pressure capsule for a spray can comprising:

a housing having a plurality of walls defining a chamber therein, said chamber being filled with pressurized fluid;

a valve, disposed in a first one of said walls; and means for moving said valve into a closed and an open position; wherein said valve is in said closed position when (1) said pressure capsule is placed in an atmospheric environment and (2) said pressure capsule is disposed in said spray can and said moving means is subjected to a pressure equal to or greater than the operating pressure of said spray can.

33. A pressure capsule according to claim 1, wherein when said space communicates with the atmospheric environment, said fluid under relatively high pressure remains contained in said first chamber.

* * * * *